US012595801B2

(12) United States Patent
Yang

(10) Patent No.: US 12,595,801 B2
(45) Date of Patent: Apr. 7, 2026

(54) FAN

(71) Applicant: Yun Yang, Dongguan (CN)

(72) Inventor: Yun Yang, Dongguan (CN)

( * ) Notice: Subject to any disclaimer, the term of this patent is extended or adjusted under 35 U.S.C. 154(b) by 0 days.

(21) Appl. No.: 18/979,662

(22) Filed: Dec. 13, 2024

(65) Prior Publication Data

US 2025/0327464 A1 Oct. 23, 2025

(30) Foreign Application Priority Data

Apr. 22, 2024 (CN) ..... 202420849147.7

(51) Int. Cl.

| | |
|---|---|
| ***F04D 27/00*** | (2006.01) |
| ***F04D 17/16*** | (2006.01) |
| ***F04D 25/06*** | (2006.01) |
| ***F04D 29/42*** | (2006.01) |
| ***F04D 29/44*** | (2006.01) |

(52) U.S. Cl.

CPC ..... *F04D 27/004* (2013.01); *F04D 17/16* (2013.01); *F04D 25/06* (2013.01); *F04D 29/4226* (2013.01); *F04D 29/441* (2013.01)

(58) Field of Classification Search

CPC .... F04D 17/16; F04D 29/4226; F04D 29/441; F04D 27/004; F04D 17/08; F04D 29/283

See application file for complete search history.

(56) References Cited

U.S. PATENT DOCUMENTS 4,103,146 A * 7/1978 Rampe ..... F24F 7/00 165/122

11,337,415 B1 * 5/2022 Ragner ..... F24H 3/0417

* cited by examiner

*Primary Examiner* — Michael L Sehn

(57) ABSTRACT

A fan includes a cage, a first fan blade, a second fan blade, a driving module, a first air guide piece, and a second air guide piece. The cage is hollow. Partition plates are disposed in the cage to divide the cage into a first mounting area for accommodating the first fan blade and a second mounting area for accommodating the second fan blade. The first fan blade is opposite to the second fan blade. The driving module is disposed on the partition plates to drive the first fan blade and the second fan blade to rotate. The partition plates are respectively connected to the first air guide piece and the second air guide piece. An air guide surface of the first air guide piece faces the first fan blade. An air guide surface of the second air guide piece faces the second fan blade.

12 Claims, 7 Drawing Sheets

FAN

TECHNICAL FIELD

The present disclosure relates to a technical field of household appliances, and in particular to a fan.

BACKGROUND

As household appliances become more and more diversified, the market puts forward higher requirements for convenience of using the household appliances on a basis of meeting functional requirements thereof.

A fan generally includes a fan blade, a rotating motor, and a control component. A user is able to operate the control component to adjust a wind speed of the fan and change a wind coverage area defined by the fan.

In the prior art, the fan generally blows in a fixed direction, resulting in an insufficient wind coverage area. Further, when the fan blade guides the air for blowing, the wind coverage area defined by the fan blade is small. Commonly, it is necessary to control the fan to swing and rotate to make up for the defects. However, there are still dead corners that cannot be covered. Such a fan setting method is unable to provide a larger wind coverage area

SUMMARY

A technical problem to be solved by embodiments of the present disclosure is to provide a fan to solve a problem that a fan setting method in the prior art is unable to provide a large wind coverage area.

The present disclosure provides a fan. The fan comprises a cage, a first fan blade, a second fan blade, a driving module, a first air guide piece, and a second air guide piece. The cage is of a hollow structure. Partition plates are disposed in the cage to divide the cage into a first mounting area and a second mounting area. The first fan blade is disposed in the first mounting area. The second fan blade is disposed in the second mounting area. The first fan blade is disposed opposite to the second fan blade.

The driving module is disposed on the partition plates to drive the first fan blade and the second fan blade to rotate. The first air guide piece and the second air guide piece are respectively connected to the partition plates. An air guide surface of the first air guide piece faces the first fan blade. An air guide surface of the second air guide piece faces the second fan blade.

Optionally, the cage comprises a top cover, a bottom cover, a first connecting ring, and adjustable air guide plates. First adjustable air guide plates of the adjustable air guide plates are disposed around the top cover and the first connecting ring, and the first adjustable air guide plates are disposed between the top cover and the first connecting ring. Second adjustable air guide plates of the adjustable air guide plates are disposed around the first connecting ring and the bottom cover. The second adjustable air guide plates are disposed between the first connecting ring and the bottom cover. The first connecting ring surrounds the partition plates.

Optionally, the partition plates comprise an upper partition plate and a lower partition plate. The upper partition plate and the lower partition plate are spaced apart from each other. The driving module comprises at least one rotating motor. The at least one rotating motor is disposed between the upper partition plate and the lower partition plate. The at least one rotating motor drives the first fan blade and the second fan blade to rotate. Through holes are defined in the upper partition plate and the lower partition plate.

Optionally, when the at least one rotating motor comprises only one rotating motor, two ends of an output shaft thereof respectively extend from two opposite ends of the one rotating motor, and the output shaft passes through the partition plates to respectively connect to the first fan blade and the second fan blade. When the at least one rotating motor comprises two rotating motors, an output shaft of a first one of the two rotating motors passes through the upper partition plate to connect to the first fan blade, and an output shaft of a second one of the two rotating motors passes through the lower partition plate to connect to the second fan blade.

Optionally, the top cover comprises a second connecting ring. The bottom cover comprises a third connecting ring. The first adjustable air guide plates are rotatably disposed between the first connecting ring and the second connecting ring. The second adjustable air guide plates are rotatably disposed between the first connecting ring and the third connecting ring. The top cover and the bottom cover are hollow.

Optionally, the fan further comprises a base and a support rod. The support rod is disposed between the base and the cage. A height of the support rod is adjustable.

Optionally, the fan further comprises a central control component. The central control component is disposed on the support rod. The central control component is electrically connected to the at least one rotating motor.

Optionally, the fan further comprises a wireless communication device connected to the central control component, so that an external mobile terminal is allowed to remotely control the fan through the wireless communication device.

Optionally, the fan further comprises a temperature sensor connected to the central control component, so that the central control component is enabled to adjust a wind speed or a switch of the fan according to a received temperature signal from the temperature sensor.

Optionally, the fan further comprises light strips, a photosensitive sensor, and an infrared sensor. The light strips are respectively disposed on the first connecting ring, the second connecting ring, and the third connecting ring. The light strips, the photosensitive sensor, and the infrared sensor are connected in series. The light strips, the photosensitive sensor, and the infrared sensor are electrically connected to the central control component.

Compared with the prior art, in the fan of the present disclosure, the cage is the hollow structure, which better allows air to flow into and out of the fan, so that the fan blades drive the air more efficiently. The first air guide piece and the first fan blade are disposed in the first mounting area, and the second air guide piece and the second fan blade are disposed in the second mounting area. On the one hand, both of the first fan blade and the second fan blade are disposed in the fan, which enhances ability of the fan to guide the air and achieve effects of rapid blowing and cooling, thereby improving a blowing effect of the fan. On the other hand, the air guide surface of the first air guide piece faces the first fan blade, and when the driving module drives the first fan blade to rotate, the first fan blade drives corresponding airflow to blow toward the air guide surface of the first air guide piece, making the corresponding airflow diffuse to a surroundings under an obstruction of the air guide surface of the first air guide piece, so as to expand a blowing area thereof. Similarly, the air guide surface of the second air guide piece faces the second fan blade, and when the driving module drives the second fan blade to rotate, the second fan blade drives corresponding airflow to blow toward the air guide surface of the second air guide piece, making the corresponding airflow diffuse to the surroundings under an obstruction of the air guide surface of the second air guide piece, so as to expand a blowing area thereof. In addition, the first fan blade is disposed opposite to the second fan blade, so the airflow diffused by the first air guide piece contacts the airflow diffused by the second air guide piece, which further changes a flow direction of the airflow, so that the airflow is diffused around the fan, achieving a 360° blowing effect, further improving the blowing area of the fan, and making the fan have a wider application range.

BRIEF DESCRIPTION OF DRAWINGS

Technical solutions of the present disclosure are further described in detail below with reference to the accompanying drawings and embodiments.

REFERENCE NUMERALS IN THE DRAWINGS

1000—fan; 100—cage; 101—first connecting ring; 102—partition plate; 1021—upper partition plate; 1022—lower partition plate; 1023—through hole; 103—top cover; 1031—second connecting ring; 1032—central area; 104—bottom cover; 1041—third connecting ring; 105—adjustable air guide plate; 110—driving module; 111—rotating motor; 200—first fan blade; 300—second fan blade; 400—first air guide piece; 500—second air guide piece; 600—output shaft; 601—connecting piece; 700—base; 800—support rod; 900—central control component.

DETAILED DESCRIPTION

It should be noted that, in the absence of conflict, the embodiments and features in the embodiments of the present disclosure can be combined with each other. In conjunction with the accompanying drawings, optional embodiments of the present disclosure are described in detail.

Figure 1:
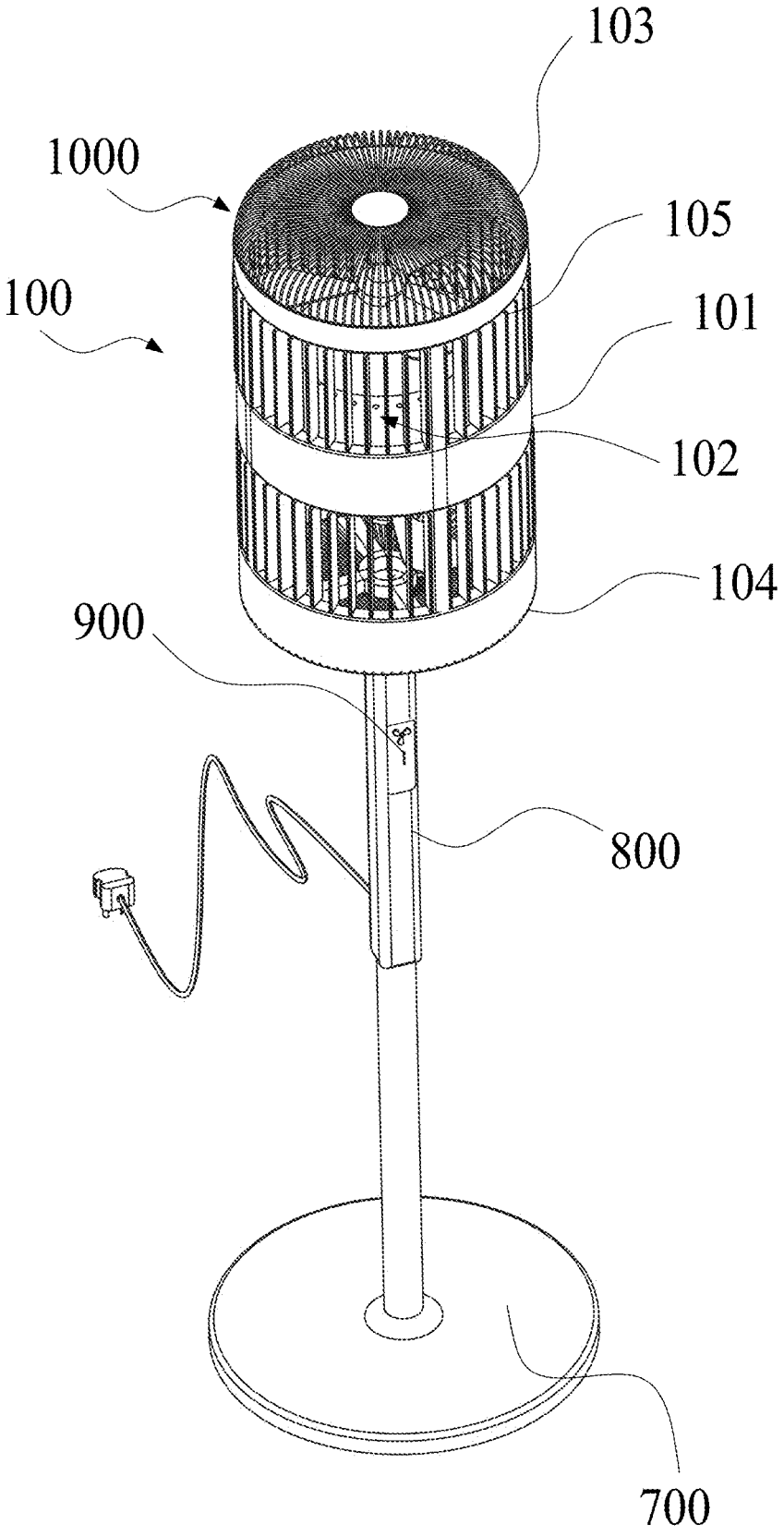
FIG. 1 is a schematic diagram of a fan according to one embodiment of the present disclosure.
Figure 2:
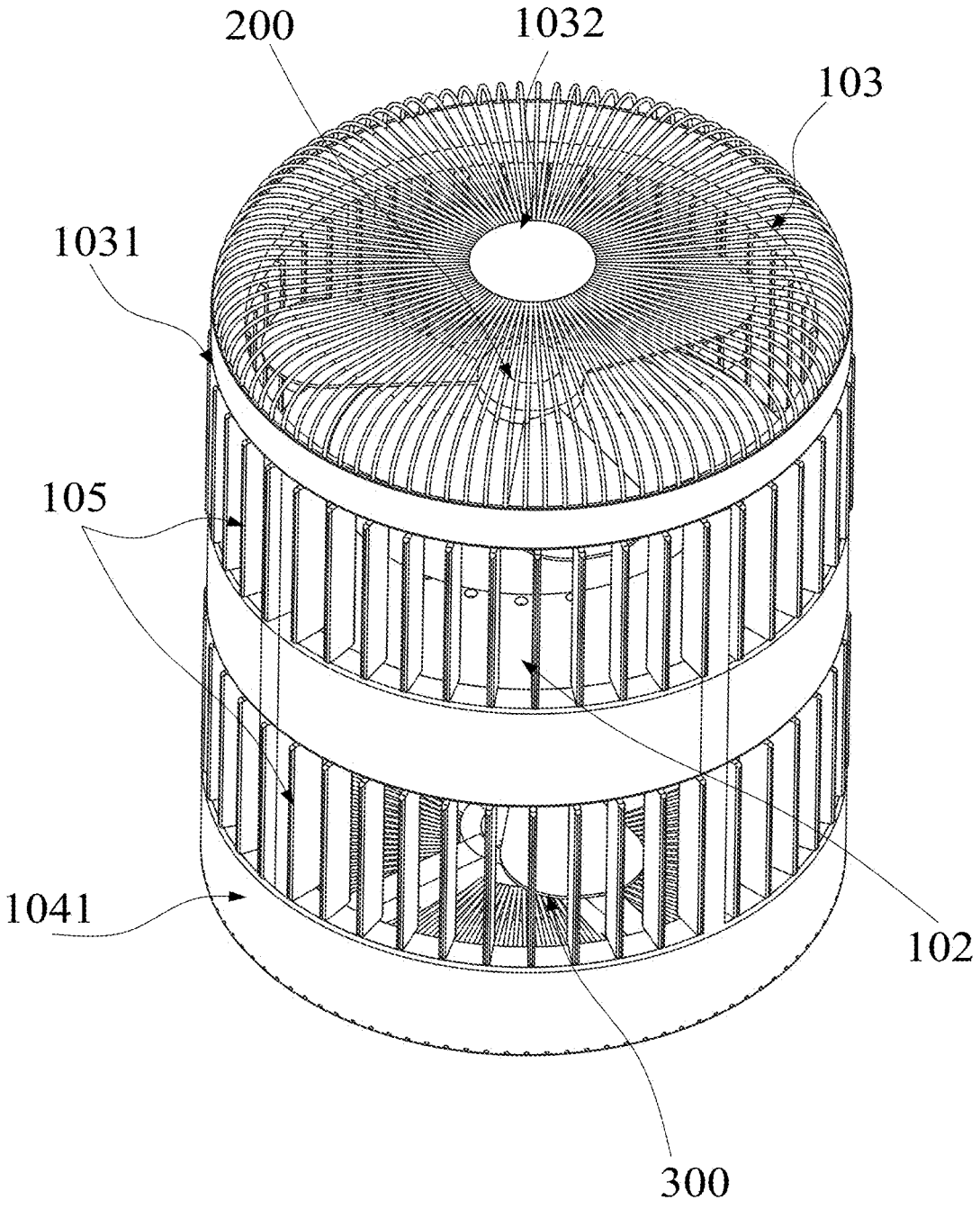
FIG. 2 is a schematic diagram of a cage according to one embodiment of the present disclosure.
Figure 3:
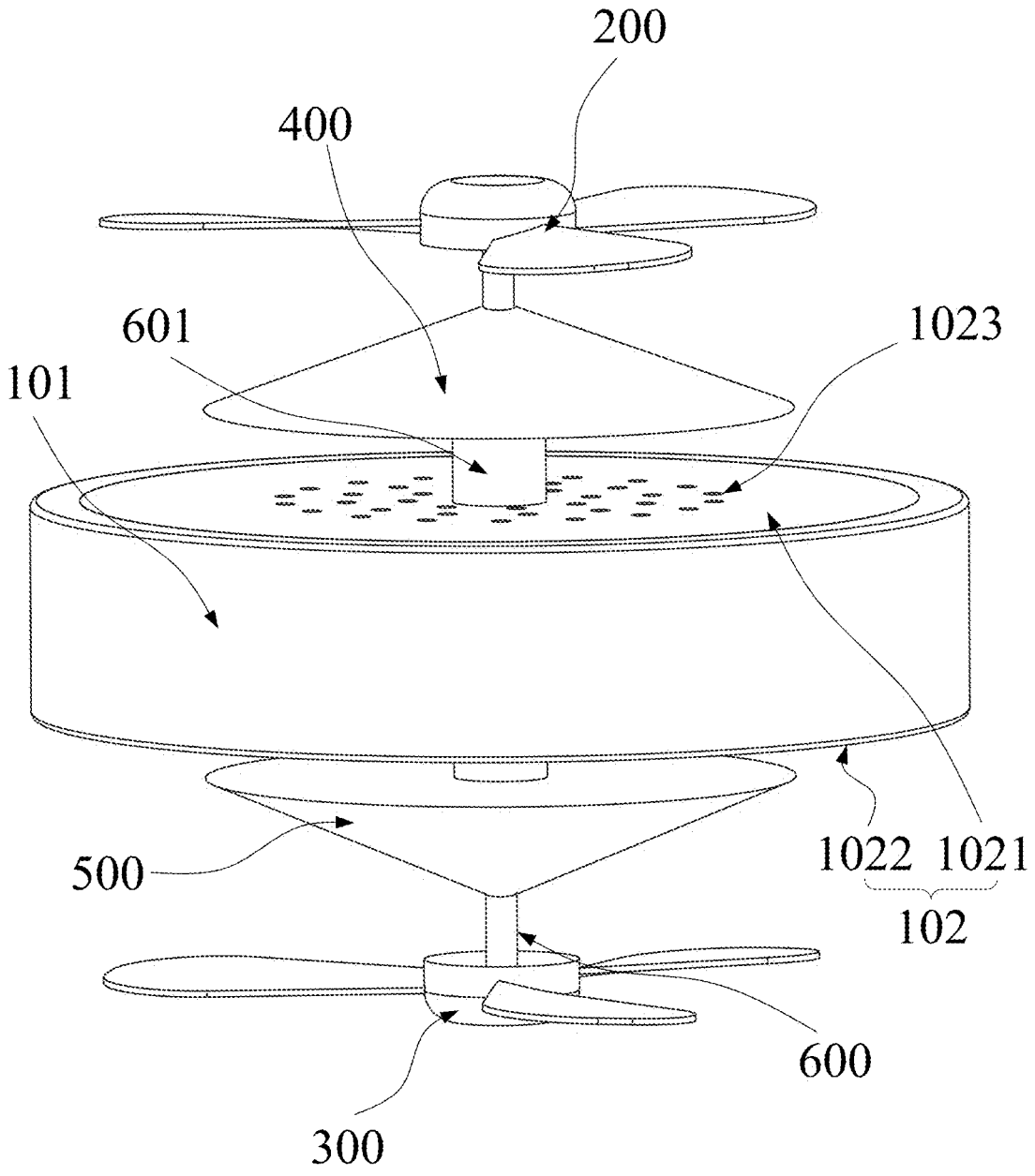
FIG. 3 is a schematic diagram of a fan blade, a second fan blade, a first air guide piece, and a second air guide piece according to one embodiment of the present disclosure.
Figure 4:
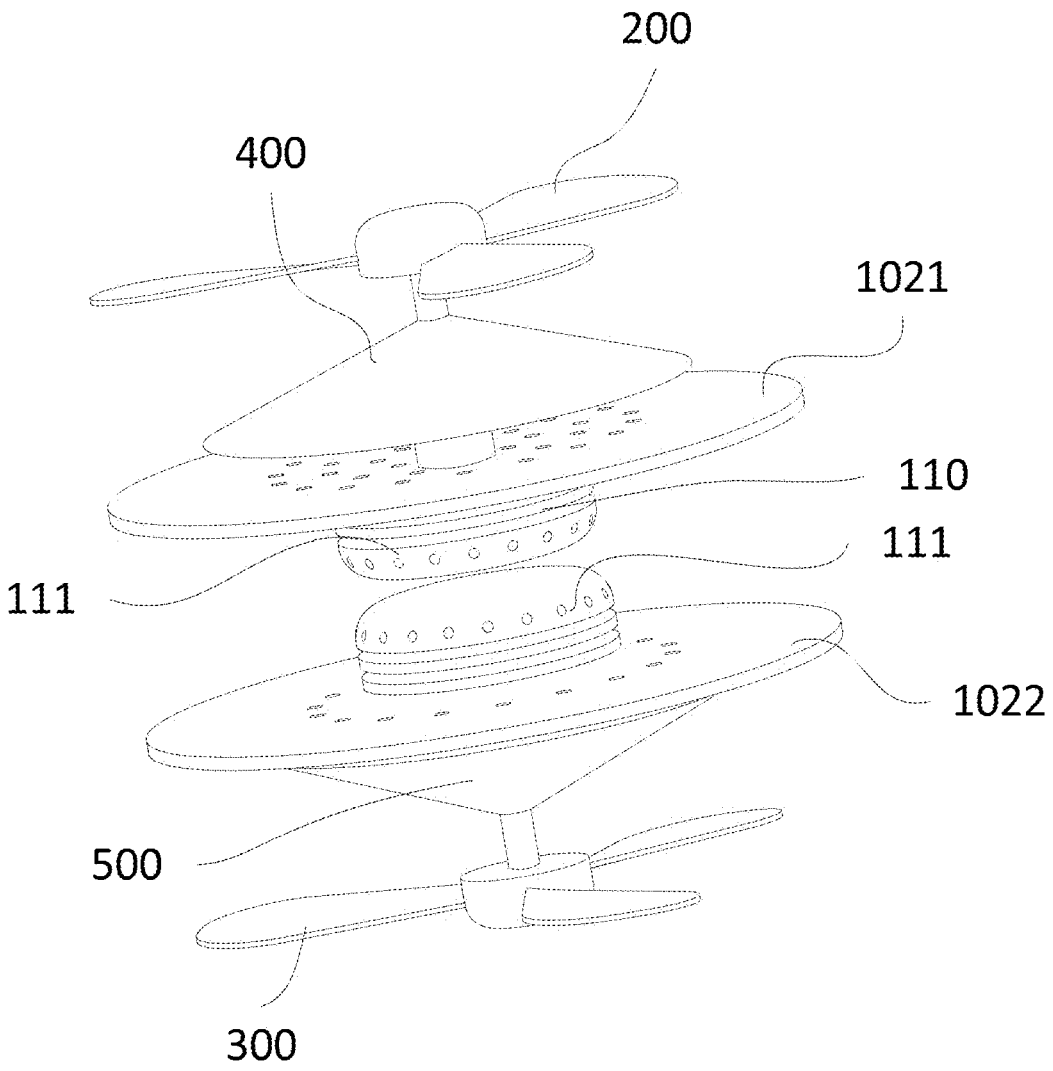
FIG. 4 is a schematic diagram of the fan according to one embodiment of the present disclosure, where only one rotating motor is provided.
Figure 5:
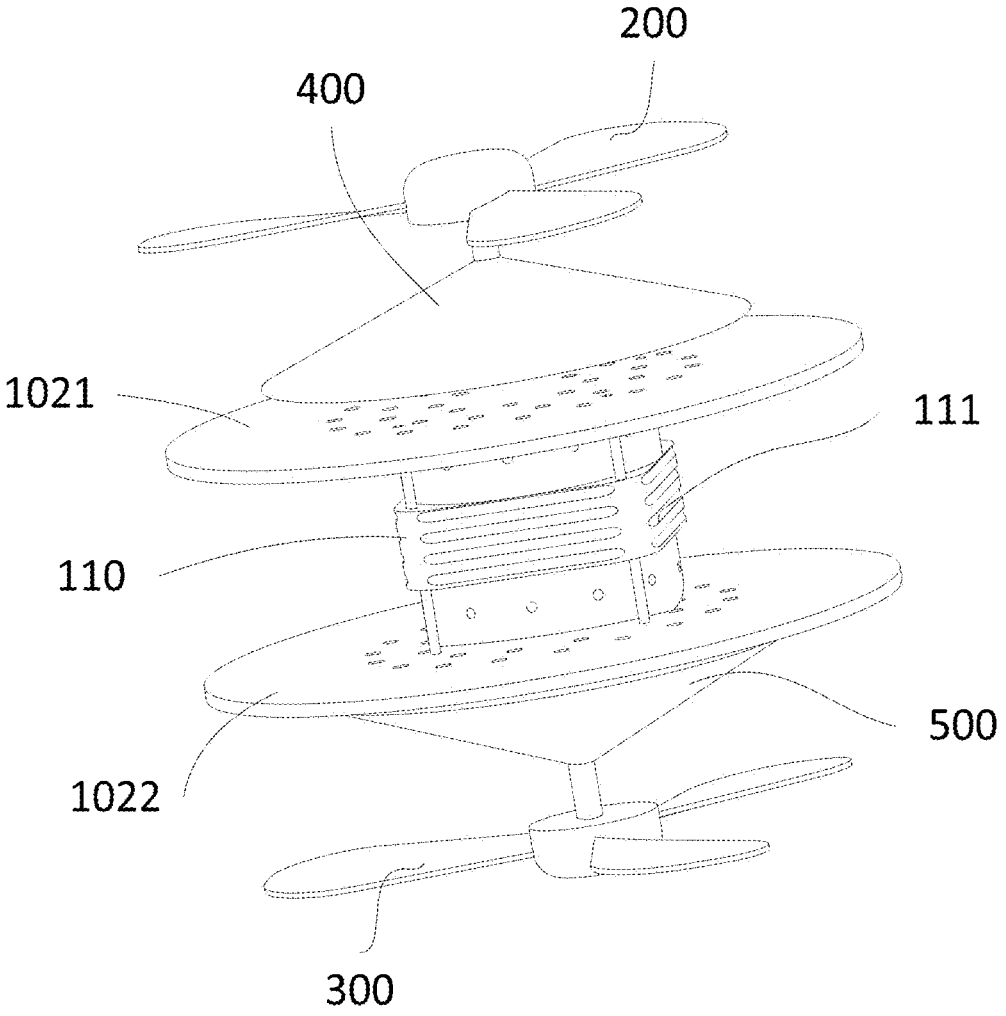
FIG. 5 is a schematic diagram of the fan according to one embodiment of the present disclosure, where two rotating motors are provided.

The present disclosure provides a fan 1000 as shown in FIGS. 1-3. The fan 1000 comprises a cage 100, a first fan blade 200, a second fan blade 300, a driving module 110, a first air guide piece 400, and a second air guide piece 500. The cage 100 is of a hollow structure. Partition plates 102 are disposed in the cage 100 to divide the cage 100 into a first mounting area and a second mounting area. The first fan blade 200 is disposed in the first mounting area. The second fan blade 300 is disposed in the second mounting area. The first fan blade 200 is disposed opposite to the second fan blade 300. The driving module 110 is disposed on the partition plates 102 to drive the first fan blade 200 and the second fan blade 300 to rotate. The first air guide piece 400 and the second air guide piece 500 are respectively connected to the partition plates 102. An air guide surface of the first air guide piece 400 faces the first fan blade 200. An air guide surface of the second air guide piece 500 faces the second fan blade 300.

The cage 100 is the hollow structure, which better allows air to flow into and out of the fan, so that the fan blades drive the air more efficiently. The first air guide piece 400 and the first fan blade 200 are disposed in the first mounting area, and the second air guide piece 500 and the second fan blade 300 are disposed in the second mounting area. On the one hand, both of the first fan blade 200 and the second fan blade 300 are disposed in the fan, which enhances ability of the fan to guide the air and achieve effects of rapid blowing and cooling, thereby improving a blowing effect of the fan. On the other hand, the air guide surface of the first air guide piece 400 faces the first fan blade 200, and when the driving module 110 drives the first fan blade 200 to rotate, the first fan blade 200 drives corresponding airflow to blow toward the air guide surface of the first air guide piece 400, making the corresponding airflow diffuse to a surroundings under an obstruction of the air guide surface of the first air guide piece 400, so as to expand a blowing area thereof. Similarly, the air guide surface of the second air guide piece 500 faces the second fan blade 300, and when the driving module 110 drives the second fan blade 300 to rotate, the second fan blade 300 drives corresponding airflow to blow toward the air guide surface of the second air guide piece 500, making the corresponding airflow diffuse to a surroundings under an obstruction of the air guide surface of the second air guide piece 500, so as to expand a blowing area thereof. In addition, the first fan blade 200 is disposed opposite to the second fan blade 300, so the airflow diffused by the first air guide piece 400 contacts the airflow diffused by the second air guide piece 500, which further changes a flow direction of the airflow, so that the airflow is diffused around the fan, achieving a 360° blowing effect, further improving the blowing area of the fan, and making the fan have a wider application range.

Specifically, by configuring the partition plates 102 in the cage 100 and by configuring the first fan blade 200 and the second fan blade 300 that are disposed in different directions in the cage 100, multi-directional air flow is achieved. The first fan blade 200 and the second fan blade 300 are disposed opposite to each other, which creates better airflow dynamics and improves overall efficiency of the fan 1000. By arranging the first air guide piece 400 and the second air guide piece 500, the air flow is guided more effectively and a heat dissipation effect is enhanced.

Specifically, the first air guide piece 400 and the second air guide piece 500 guide the airflow to diffuse, and the cage 100 of the hollow structure optimizes the air flow and heat dissipation performance. Thus, overall blowing and heat dissipation efficiency of the fan 1000 is improved. While improving air flow and heat dissipation, energy consumption is reduced and performance is improved.

Specifically, the partition plates 102 separate the cage 100 into different areas, such as the first mounting area and the second mounting area, which optimize an air flow path, so that the first fan blade 200 and the second fan blade 300 are enabled to blow air to cool corresponding positions, thereby improving the overall efficiency of the fan 1000.

It should be noted that the first air guide piece 400 and the second air guide piece 500 are respectively disposed on the partition plates 102 through connecting pieces 601. Further, the first air guide piece 400 and a first one of the connecting pieces 601 define first limiting holes, and the driving module 110 passes through the first limiting holes to connect to the first fan blade 200. Similarly, the second air guide piece 500 and a second one of the connecting pieces 601 define second limiting holes, and the driving module 110 passes through the second limiting holes to connect to the second fan blade 300. In this way, the driving module 110 only needs to be connected to the first fan blade 200 and the second fan blade 300, which avoids an excessive burden of the driving module 110 and avoids affecting cooling efficiency of the fan 1000.

It should be noted that the first air guide piece 400 and the second air guide piece 500 have a variety of configurations. For example: both of the first air guide piece 400 and the second air guide piece 500 are bosses, cones, pyramids or polygonal columns. For another example: each of the first air guide piece 400 and the second air guide piece 500 is selected from one of a boss, a cone, a pyramid and a polygonal column, and a structure of the first air guide piece 400 is different from a structure of the second air guide piece 500.

As shown in FIG. 2, the cage 100 comprises a top cover 103, a bottom cover 104, a first connecting ring 101, and adjustable air guide plates 105. First adjustable air guide plates 105 of the adjustable air guide plates 105 are disposed around the top cover 103 and the first connecting ring 101, and first adjustable air guide plates 105 are disposed between the top cover 103 and the first connecting ring 101. Second adjustable air guide plates 105 of the adjustable air guide plates 105 are disposed around the first connecting ring 101 and the bottom cover 104. The second adjustable air guide plates 105 are disposed between the first connecting ring 101 and the bottom cover 104. The first connecting ring 101 surrounds the partition plates 102.

The adjustable air guide plates 105 are able to control the airflow passing through by changing their own angles, so that a flow direction and a flow speed of the airflow are changed. In actual use, when it is necessary to centrally blow air and cool down a certain area, the adjustable air guide plates 105 facing other positions are closed, and only the adjustable air guide plates 105 facing the certain area are opened to control the flow direction and the flow speed of the airflow, so that the airflow is blown to the certain area as desired. When there is no need to blow the air to the certain area, the adjustable air guide plates 105 facing the certain area are closed to ensure that the airflow is not blown to the certain area. By adjusting positions of the adjustable air guide plates 105, the flow direction and the flow speed of the airflow are controlled, which improves controllability of the fan 1000 and the flexibility of the fan 1000 to a certain extent while improving the efficiency and performance of the fan 1000.

Specifically, the user may manually or remotely control the positions and angles of the adjustable air guide plates 105. For example, the adjustable air guide plates 105 are automatically adjusted through BLUETOOTH or an operation panel of the fan 1000, thereby improving intelligence and convenience of the fan 1000.

As shown in FIG. 3, the partition plates 102 comprise an upper partition plate 1021 and a lower partition plate 1022. The upper partition plate 1021 and the lower partition plate 1022 are spaced apart from each other. The driving module 110 comprises at least one rotating motor 111. The at least one rotating motor 111 is disposed between the upper partition plate 1021 and the lower partition plate 1022. The at least one rotating motor 111 drives the first fan blade 200 and the second fan blade 300 to rotate. Through holes 1023 are defined in the upper partition plate 1021 and the lower partition plate 1022.

Specifically, since the upper partition plate 1021 and the lower partition plate 1022 are spaced apart, a space is defined between the upper partition plate 1021 and the lower partition plate 1022. Therefore, the at least one rotating motor 111 is allowed to be disposed in the space. The at least one rotating motor 111 is disposed between the upper partition plate 1021 and the lower partition plate 1022, and the at least one rotating motor 111 is drivingly connected to the first fan blade 200 and the second fan blade 300, so that the at least one rotating motor 111 is able to drive the first fan blade 200 and the second fan blade 300 to move.

Specifically, the upper partition plate 1021 and the lower partition plate 1022 comprise the through holes 1023, and the through holes 1023 are configured for heat dissipation and air circulation. The through holes 1023 help air flow more smoothly and improve the heat dissipation effect of the fan 1000.

It should be noted that when the at least one rotating motor 111 comprises one rotating motor 111, the one rotating motor 111 drives the first fan blade 200 and the second fan blade 300 to rotate at the same time. When the at least one rotating motor 111 comprises two rotating motors 111, a first one of the rotating motors 111 drives the first fan blade 200 to rotate, and a second one of the rotating motors 111 drives the second fan blade 300 to rotate.

In one optional embodiment, when the at least one rotating motor 111 comprises only one rotating motor 111, an output shaft 600 extends from two opposite ends of the one rotating motor 111, and the output shaft 600 passes through the partition plates 102 to respectively connect to the first fan blade 200 and the second fan blade 300. When the at least one rotating motor 111 comprises the two rotating motors 111, an output shaft 600 of the first one of the two rotating motors 111 passes through the upper partition plate 1021 to connect to the first fan blade 200, and an output shaft 600 of the second one of the two rotating motors 111 passes through the lower partition plate 1022 to connect to the second fan blade 300.

When the one rotating motor 111 is disposed between the upper partition plate 1021 and the lower partition plate 1022, the output shaft 600 for transmission is disposed on the one rotating motor 111, and the output shaft 600 passes through the partition plates 102. Thus, a first end of the output shaft 600 is connected to the first fan blade 200 and a second end of the output shaft 600 is connected to the second fan blade 300. By such connection mode, the one rotating motor 111 is able to drive two fan blades to work simultaneously through one output shaft 600. When one rotating motor 111 is provided, a size of the fan 1000 is optimized, overall air flow efficiency is improved, and an occupied space of the fan 1000 is reduced.

Alternatively, when the two rotating motors 111 are disposed between the upper partition plate 1021 and the lower partition plate 1022, the first one of the rotating motors 111 is connected to the first fan blade 200 through the output shaft 600 thereof, and the second one of the rotating motors 111 is connected to the second fan blade 300 through the output shaft 600 thereof. By such connection mode, each of the rotating motors 111 has a corresponding output shaft 600. That is, the first fan blade 200 and the second fan blade 300 do not need to be started and closed at the same time. The user may start the first fan blade 200 and/or the second fan blade 300 according to an actual situation to meet needs.

Specifically, the at least one rotating motor 111 is connected to the first fan blade 200 and/or the second fan blade 300 through at least one output shaft 600 thereof. Such connection method is relatively simple and reliable, and ensures effective transmission and operation between the at least one rotating motor 111, the first fan blade 200 and/or the second fan blade 300. Therefore, the reliability and the stability of the fan 1000 are improved, a failure rate is reduced, and service life is prolonged.

It should be noted that in the embodiment where only one rotating motor 111 is provided, the output shaft 600 of the one rotating motor 111 should extend from two opposite ends of the one rotating motor 111, so that the first fan blade 200 and the second fan blade 300 are driven and connected by the one rotating motor 111. In the embodiment where two rotating motors 111 are provided, each of the rotating motors 111 has the corresponding output shaft 600 extending from only one end thereof for driving and connecting with the first fan blade 200 or the second fan blade 300.

As shown in FIG. 2, the top cover 103 comprises a second connecting ring 1031. The bottom cover 104 comprises a third connecting ring 1041. The first adjustable air guide plates 105 are rotatably disposed between the first connecting ring 101 and the second connecting ring 1031. The second adjustable air guide plates 105 are rotatably disposed between the first connecting ring 101 and the third connecting ring 1041. The top cover 103 and the bottom cover 104 are hollow.

The top cover 103 comprises the second connecting ring 1031. The bottom cover 104 comprises the third connecting ring 1041. The first adjustable air guide plates 105 are rotatably disposed between the first connecting ring 101 and the second connecting ring 1031. The second adjustable air guide plates 105 are rotatably disposed between the first connecting ring 101 and the third connecting ring 1041. The second connecting ring 1031 is configured to enhance a structural strength of the top cover 103 and allows the top cover 103 to have an area for connecting the first adjustable air guide plates 105. Similarly, the third connecting ring 1041 is configured to enhance a structural strength of the bottom cover 104 and allows the bottom cover 104 to have an area for connecting the second adjustable air guide plates 105. The second connecting ring 1031 and the third connecting ring 1041 provide a larger area for connection or selection, making mounting of the first adjustable air guide plates 105 between the second connecting ring 1031 and the first connecting ring 101 and mounting of the second adjustable air guide plate 105 between the first connecting ring 101 and the third connecting ring 1041 more stable and reliable, thereby enhancing a structural strength and the stability of the fan 1000.

Specifically, the first adjustable air guide plates 105 are rotatably disposed between the first connecting ring 101 and the second connecting ring 1031. The second adjustable air guide plates 105 are rotatably disposed between the first connecting ring 101 and the third connecting ring 1041.

When the adjustable air guide plates 105 are driven, the adjustable air guide plates 105 are rotated relative to the cage 100. In actual use, each two adjacent adjustable air guide plates 105 cooperate with each other to change an angle therebetween or a size of an opening formed therebetween, thereby changing the flow speed and the flow direction of the airflow blown by the fan 1000. A layout of the adjustable air guide plates 105 helps to control a path and the flow direction of the airflow. By adjusting the adjustable air guide plates 105, the flow direction and the flow speed of the airflow are adjusted, thereby improving the efficiency and the performance of the fan 1000.

Specifically, the top cover 103 and the bottom cover 104 are hollow, which are conductive to dissipating heat and circulating the air. Hollow portions thereof improve efficiency of air flow, reduce an operating temperature of the fan 1000, and enhance the blowing and the cooling efficiency of the fan 1000, thereby improving the heat dissipation effect. Further, the hollow portions of the top cover 103 and the bottom cover 104 reduce an overall weight, making it easier to move the fan 1000 and change a blowing direction, thereby improving the flexibility of the fan 1000.

As shown in FIG. 1, the fan 1000 further comprises a base 700 and a support rod 800. The support rod 800 is disposed between the base 700 and the cage 100. A height of the support rod 800 is adjustable.

When the base 700 and the support rod 800 are not provided, the fan 1000 is able to be placed on a desktop or a platform for the user to use. When the base 700 and the support rod 800 are added to the fan 1000, the fan 1000 is placed on a floor through the support rod 800 and the base 700. The fan 1000 is allowed to be raised to a certain height to meet a usage requirement. The height of the support rod 800 is adjustable, and the user is able to adjust the height of the support rod 800 as needed to obtain a better air flow effect or meet the needs of different usage scenarios. The base 700 and the support rod 800 provide greater flexibility and personalized choices.

Specifically, the base 700 and the support rod 800 increase the stability of the fan 1000. By configuring the support rod 800 on the base 700, additional support and balance is provided to increase safety and prevent the fan 1000 from shaking and tilting during use. Moreover, the bottom cover 104 that is hollow is not in contact with the desktop or the platform, which increases the blowing area of the fan 1000 and enhances the blowing and cooling effect of the fan 1000. By adjusting the height of the support rod 800, the user is allowed to better position the fan 1000 to make the airflow more comfortable and effective. For example, the fan 1000 is raised to a suitable height to prevent the airflow from blowing directly toward the human body, thereby improving comfort of the user.

As shown in FIG. 1, the fan 1000 further comprises a central control component 900. The central control component 900 is disposed on the support rod 800. The central control component 900 is electrically connected to the at least one rotating motor 111.

Of course, the central control component 900 may be disposed in other positions, as long as the central control component 900 is electrically connected to the at least one rotating motor 111 to realize control of the at least one rotating motor 111. In some alternative embodiment, the central control component 900 may be wirelessly connected to the at least one rotating motor 111, such as wirelessly connected to connected to the at least one rotating motor 111 via BLUETOOTH. In addition, the central control component 900 may be disposed on a housing of the cage 100, so that the fan is allowed to be operated by the user when the cage is placed on a desktop and the fan is served as a desk fan. Alternatively, the central control component 900 may be disposed on the base 700. Optionally, as shown in FIG. 2, the central control component 900 is disposed on a central area 1032 of the top cover 103.

The user may conveniently control the fan 1000 through the central control component 900, such as controlling the wind speed, a wind level, etc. Centralized control of the central control component 900 simplifies user operation and improves the convenience of use. Since the central control component 900 is electrically connected to the at least one rotating motor 111, the user may conveniently control a switch and functions of the fan 1000 directly through the central control component 900, or the user may control the fan 1000 through an additional wire remote control or a controller, which is convenient to operate.

By providing the central control component 900, the fan further comprises intelligent functions. For example, the central control component 900 may be connected to a smart home system to achieve intelligent operations such as remote control and timer switch of the fan 1000, thereby improving the user experience. It should be noted that in the embodiment, the central control component 900 may have many functions, such as: human-computer voice interaction function, timing function, mode switching function, touch screen function, and other practical functions, which further improve applicability and functionality of the fan 1000.

Furthermore, in one optional embodiment, the fan 1000 further comprises a wireless communication device connected to the central control component, so that an external mobile terminal is allowed to remotely control the fan 1000 through the wireless communication device.

The wireless communication device enables the user to remotely control the fan 1000 through a smart phone or other mobile terminal with a BLUETOOTH control function. The user may use the smart phone or other mobile terminal to remotely control the fan 1000, such as adjusting the wind speed, performing the timer switch, etc., without directly contacting the central control component 900 of the fan 1000. The wireless communication device enhances an intelligent operation experience of the user and improves the convenience and flexibility of control.

Specifically, a remote control function of the wireless communication device further achieve personalized settings of the fan 1000. The user may set a working mode of the fan 1000 according to his or her preferences and needs. The wireless communication device provides the user with a more personalized use experience. The remote control function provides a more convenient operation method. The user may control the fan 1000 without contacting the fan 1000, which is particularly suitable for some special scenarios or the user with physical inconveniences.

Furthermore, in one optional embodiment, the fan 1000 further comprises a temperature sensor connected to the central control component 900, so that the central control component 900 is enabled to adjust the wind speed or the switch of the fan according to a received temperature signal from the temperature sensor.

The temperature sensor is configured to transmit a temperature signal to the central control component 900 according to an ambient temperature. The central control component 900 automatically adjusts the wind speed of the fan 1000 according to the received temperature signal, or controls opening and closing of the fan 1000 to achieve intelligent opening or closing. When the ambient temperature is too high, the central control component 900 controls the fan 1000 to start to reduce the ambient temperature. When the ambient temperature is suitable, the central control component 900 controls the fan 1000 to turn off to save energy. The temperature sensor is further configured to monitor a room temperature according to a constant temperature mode set by the user. When the room temperature is too high or too low, the central control component 900 adjusts the wind level or the blowing direction of the fan 1000 according to the received temperature signal to keep the room temperature in a constant range. The temperature sensor generally works during asleep period of the user to maintain a comfortable room temperature and enhance the comfort of the user.

Specifically, by providing the temperature sensor, user's manual control of the fan 1000 is reduced, thereby saving time and energy of the user for manual operation and improving the convenience of use.

In one optional embodiment, the fan 1000 further comprises light strips, a photosensitive sensor, and an infrared sensor. The light strips are respectively disposed on the first connecting ring 101, the second connecting ring 1031, and the third connecting ring 1041. The light strips, the photosensitive sensor, and the infrared sensor are connected in series. The light strips, the photosensitive sensor, and the infrared sensor are electrically connected to the central control assembly 900.

By providing the light strips on the first connecting ring 101, the second connecting ring 1031, and the third connecting ring 1041, the fan 1000 is enabled to have a lighting function. The light strips meet basic lighting needs and are configured as a night light at night, thereby improving the functionality of the fan 1000. Furthermore, by providing the light strips on the first connecting ring 101, the second connecting ring 1031, and the third connecting ring 1041, partition control of the light is achieved, providing more flexible lighting options. For example, the user is able to select and control lights of different light strips individually as needed to meet the personalized needs.

Specifically, the light strips, the photosensitive sensor, and infrared sensor are connected in series, which jointly provide an induction lighting function at night. The photosensitive sensor is a sensor that responds to external light signals or light radiation. Alternatively, the photosensitive sensor is a sensor that converts the external light signals or the light radiation. Therefore, when an indoor visible light is low at night or in rainy weather, a resistance value in the photosensitive sensor decreases to turn on the photosensitive sensor. The infrared sensor is configured to detect a distance between a person or an object and the fan. When the distance between the person or the object and the fan is within a response range of the infrared sensor, the infrared sensor feeds back an electrical signal to the central control component 900, and then the central control component 900 controls the light strips to turn on or off, thereby realizing the induction lighting function of the fan at night.

Specifically, the light strips are electrically connected to the central control component 900, and the user is able to control a color, a hue or a brightness of each of the light strips through the external terminal device or the central control component according to personal preferences. The light strips play a certain decorative function and improve an appearance of the fan. The light strips that are intelligently controlled not only provide the lighting function, but also make the appearance of the fan 1000 more beautiful and fashionable.

It should be noted that in this embodiment, the light strips are able to emit light of different colors. That is, the light strips are configured as a colorful atmosphere light. The user is able to adjust a brightness and a color temperature of the light strips through the central control component 900, so the light strips create different atmospheres and improve the comfort and specific needs of the user.

Figure 6:
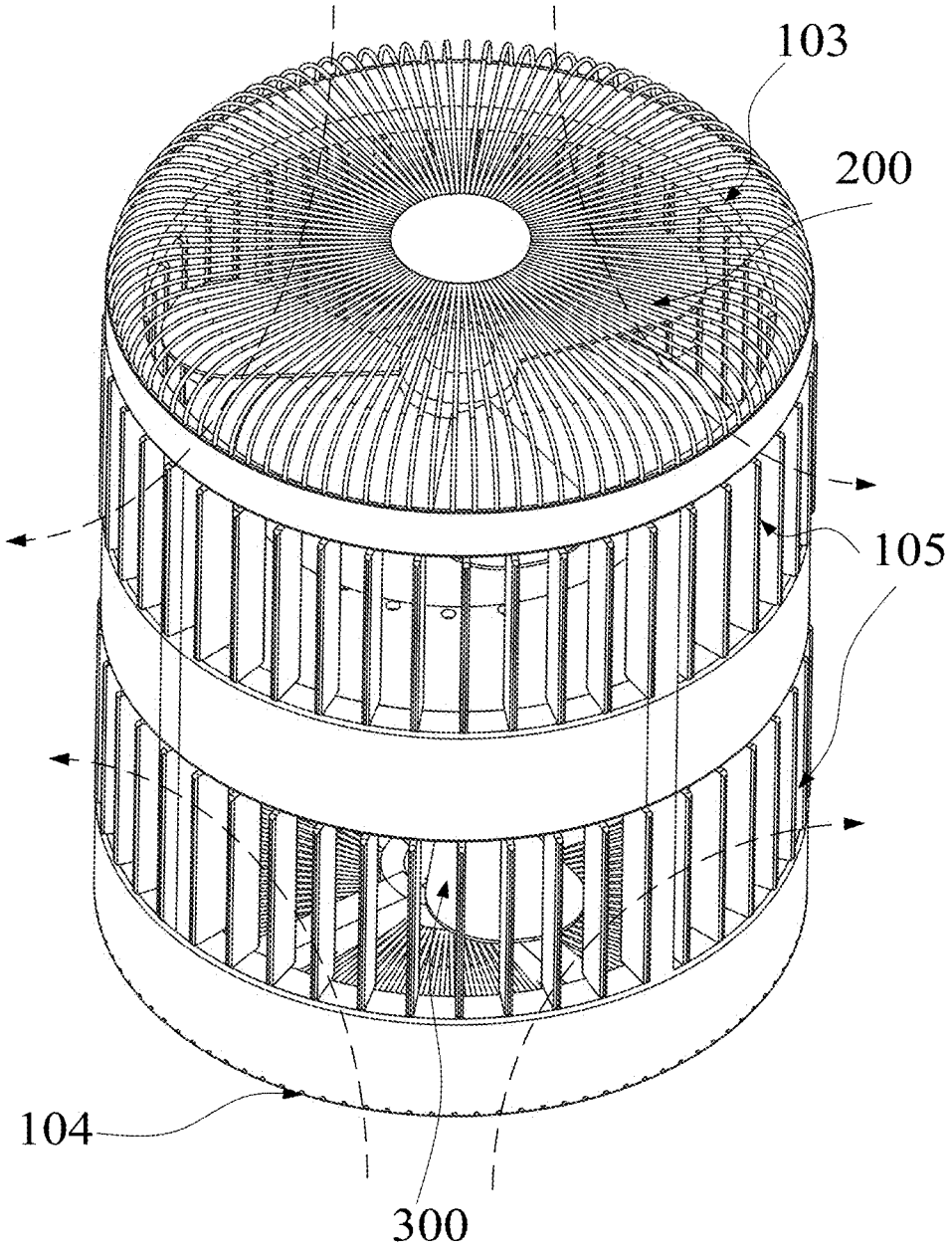
FIG. 6 is a schematic diagram of an air flow condition of the fan shown in FIG. 2.
Figure 7:
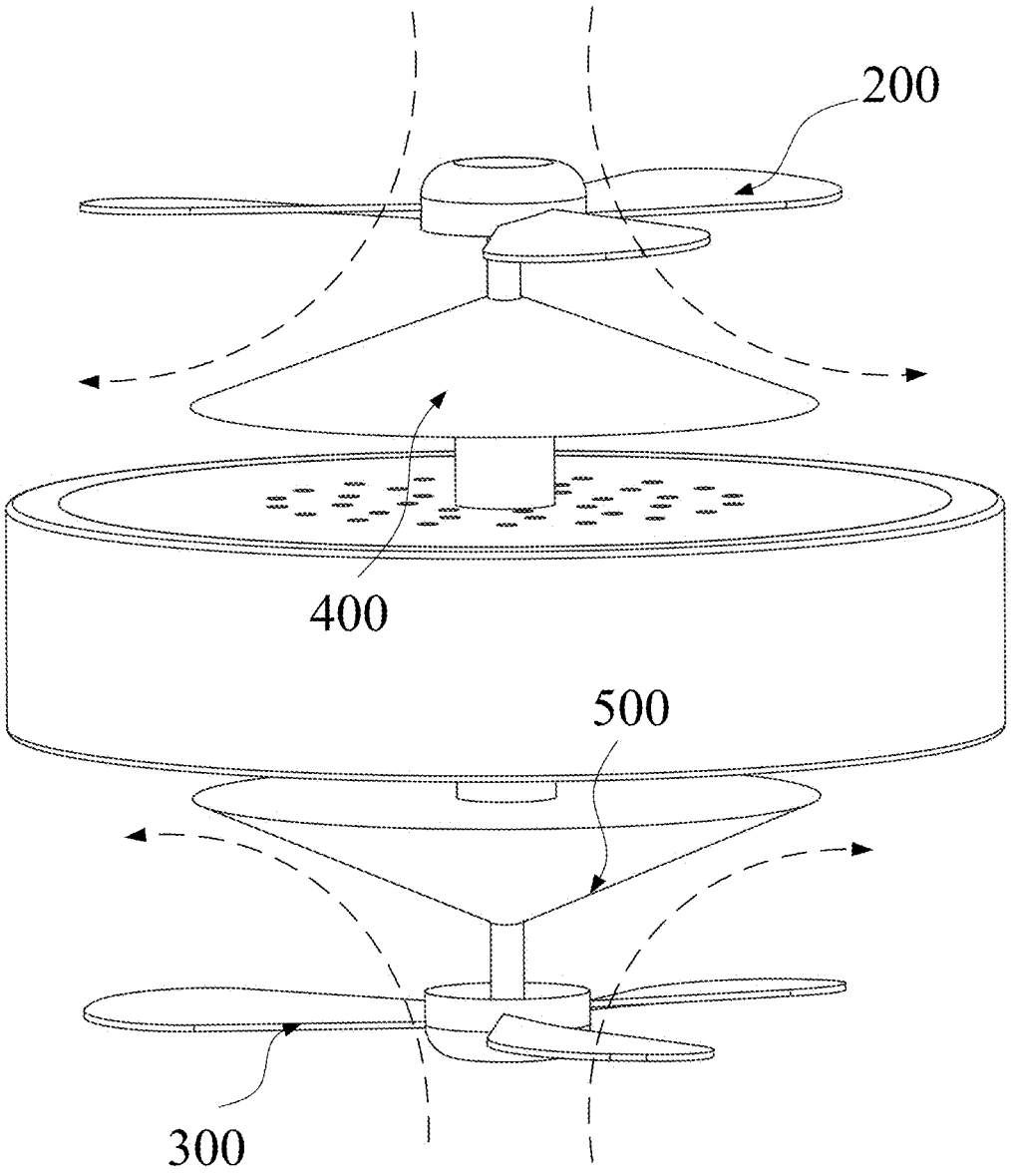
FIG. 7 is a schematic diagram of an air flow condition of the fan shown in FIG. 3.

An air flow condition is shown in FIGS. 6 and 7. The dotted arrows are directed to directions of the air flow. On the one hand, under the rotation of the first blade 200, the external air is sucked from the top cover 103 and then blown out from the adjustable air guide plates 105. Similarly, under the rotation of the second blade 300, the external air is sucked from the bottom cover 104 and then blown out from the adjustable wind guide plates 105. Furthermore, in conjunction with FIG. 7, the air flow in the fan is further described. Under the rotation of the first blade 200, the air flow is blown from a top portion of the fan shown in FIG. 7 to the air guide surface of the first air guide piece 400. Then, a direction of the air flow is changed on the air guide surface of the first wind guide piece 400 and the air flow is blown to the surroundings. Similarly, under the rotation of the second blade 300, the air flow is blown from a bottom portion of the fan shown in FIG. 7 to the air guide surface of the second air guide piece 500, and the direction of the air flow is changed on the air guide surface of the second wind guide piece 500 and the air flow is blown to the surroundings.

It should be understood that above embodiments are only used to illustrate the technical solutions of the present disclosure rather than to limit the present disclosure. Those skilled in the art may modify the technical solutions described in the above embodiments or make equivalent replacements for part of the technical features therein; and all these modifications and replacements shall fall within the protection scope of the attached claims of the present disclosure.

What is claimed is:

1. A fan, comprising:

a cage;

a first fan blade;

a second fan blade;

a driving module;

a first air guide piece; and a second air guide piece;

wherein the cage is of a hollow structure, partition plates are disposed in the cage to divide the cage into a first mounting area and a second mounting area, the first fan blade is disposed in the first mounting area, the second fan blade is disposed in the second mounting area, and the first fan blade is disposed opposite to the second fan blade;

wherein the driving module is disposed on the partition plates to drive the first fan blade and the second fan blade to rotate, the partition plates are respectively connected to the first air guide piece and the second air guide piece, an air guide surface of the first air guide piece faces the first fan blade, and an air guide surface of the second air guide piece faces the second fan blade.

2. The fan according to claim 1, wherein the cage comprises a top cover, a bottom cover, a first connecting ring, and adjustable air guide plates; wherein first adjustable air guide plates of the adjustable air guide plates are disposed around the top cover and the first connecting ring, and the first adjustable air guide plates are disposed between the top cover and the first connecting ring; second adjustable air guide plates of the adjustable air guide plates are disposed around the first connecting ring and the bottom cover, the second adjustable air guide plates are disposed between the first connecting ring and the bottom cover, and the first connecting ring surrounds the partition plates.

3. The fan according to claim 2, wherein the top cover comprises a second connecting ring, the bottom cover comprises a third connecting ring, the first adjustable air guide plates are rotatably disposed between the first connecting ring and the second connecting ring, the second adjustable air guide plates are rotatably disposed between the first connecting ring and the third connecting ring, and the top cover and the bottom cover are hollow.

4. The fan according to claim 3, wherein the fan further comprises light strips, a photosensitive sensor, and an infrared sensor; wherein the light strips are respectively disposed on the first connecting ring, the second connecting ring, and the third connecting ring, wherein the light strips, the photosensitive sensor, and the infrared sensor are connected in series.

5. The fan according to claim 3, wherein the fan further comprises a central control component;

wherein the driving module comprises at least one rotating motor, and the at least one rotating motor drives the first fan blade and the second fan blade to rotate;

wherein the central control component is electrically connected to the at least one rotating motor, wherein the fan further comprises light strips, a photosensitive sensor, and an infrared sensor, wherein the light strips are respectively disposed on the first connecting ring, the second connecting ring, and the third connecting ring;

wherein the light strips, the photosensitive sensor, and the infrared sensor are connected in series, and the light strips, the photosensitive sensor, and the infrared sensor are electrically connected to the central control component.

6. The fan according to claim 1, wherein the partition plates comprise an upper partition plate and a lower partition plate, the upper partition plate and the lower partition plate are spaced apart from each other, the driving module comprises at least one rotating motor, the at least one rotating motor is disposed between the upper partition plate and the lower partition plate, the at least one rotating motor drives the first fan blade and the second fan blade to rotate, and through holes are defined in the upper partition plate and the lower partition plate.

7. The fan according to claim 6, wherein when the at least one rotating motor comprises only one rotating motor, an output shaft thereof extends from two opposite ends of the one rotating motor, and the output shaft passes through the partition plates to respectively connect to the first fan blade and the second fan blade; when the at least one rotating motor comprises two rotating motors, an output shaft of a first one of the two rotating motors passes through the upper partition plate to connect to the first fan blade, and an output shaft of a second one of the two rotating motors passes through the lower partition plate to connect to the second fan blade.

8. The fan according to claim 7, wherein the fan further comprises a base and a support rod, the support rod is disposed between the base and the cage, and a height of the support rod is adjustable.

9. The fan according to claim 8, wherein the fan further comprises a central control component, the central control component is disposed on the support rod, and the central control component is electrically connected to the at least one rotating motor.

10. The fan according to claim 9, wherein the fan further comprises a wireless communication device connected to the central control component, so that an external mobile terminal is allowed to remotely control the fan through the wireless communication device.

11. The fan according to claim 9, wherein the fan further comprises a temperature sensor connected to the central control component, so that the central control component is enabled to adjust a wind speed or a switch of the fan according to a received temperature signal from the temperature sensor.

12. The fan according to claim 1, wherein the fan further comprises a central control component, the driving module comprises at least one rotating motor, and the central control component is electrically connected to the at least one rotating motor.

* * * * *